US011898230B2

(12) United States Patent
Yoshioka et al.

(10) Patent No.: US 11,898,230 B2
(45) **Date of Patent: *Feb. 13, 2024**

(54) HIGH-STRENGTH STEEL SHEET AND METHOD FOR MANUFACTURING SAME

(71) Applicant: JFE Steel Corporation, Tokyo (JP)

(72) Inventors: Shimpei Yoshioka, Tokyo (JP); Yoshihiko Ono, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 383 days.

This patent is subject to a terminal disclaimer.

(21) Appl. No.: 17/269,312

(22) PCT Filed: Jun. 10, 2019

(86) PCT No.: PCT/JP2019/022848

§ 371 (c)(1),
(2) Date: Feb. 18, 2021

(87) PCT Pub. No.: WO2020/039696

PCT Pub. Date: Feb. 27, 2020

(65) Prior Publication Data

US 2021/0180163 A1 Jun. 17, 2021

(30) Foreign Application Priority Data

Aug. 22, 2018 (JP) ..... 2018-155231

(51) Int. Cl.
*C22C 38/06* (2006.01)
*C21D 8/02* (2006.01)
(Continued)

(52) U.S. Cl.
CPC ..... *C22C 38/06* (2013.01); *C21D 8/0236* (2013.01); *C21D 9/46* (2013.01); *C22C 38/002* (2013.01);
(Continued)

(58) Field of Classification Search
CPC .. C21D 1/74; C21D 2211/002; C21D 8/0226; C21D 2211/008; C21D 8/0236;
(Continued)

(56) References Cited

U.S. PATENT DOCUMENTS 8,449,988 B2 5/2013 Shiraki et al.
8,951,367 B2 2/2015 Kawamura et al.
(Continued)

FOREIGN PATENT DOCUMENTS

CN 106574340 A 4/2017
EP 2518181 10/2012
(Continued)

OTHER PUBLICATIONS

Korean Office Action for Korean Application No. 10-2021-7005058, dated Aug. 1, 2022, with Concise Statement of Relevance of Office Action, 6 pages.
(Continued)

*Primary Examiner* — Jie Yang
(74) *Attorney, Agent, or Firm* — RatnerPrestia

(57) ABSTRACT

A high-strength steel sheet according to the present invention includes a specific chemical composition, and a steel structure in which a total area fraction of martensite and bainite in a position of ¼ of a sheet thickness is 95% or more and 100% or less, the balance in a case where the total area fraction is not 100% contains retained austenite, and an area fraction of ferrite in a region extending up to 10 μm in a sheet thickness direction from a surface is 10% or more and 40% or less, in which a tensile strength is 1320 MPa or more, and a Vickers hardness in a position of 15 μm in the sheet thickness direction from the surface satisfies a specified formula.

4 Claims, 1 Drawing Sheet

(51) Int. Cl.

| | |
|---|---|
| ***C21D 9/46*** | (2006.01) |
| ***C22C 38/00*** | (2006.01) |
| ***C22C 38/02*** | (2006.01) |
| ***C22C 38/04*** | (2006.01) |

(52) U.S. Cl.
CPC ..... *C22C 38/02* (2013.01); *C22C 38/04* (2013.01); *C21D 2211/001* (2013.01); *C21D 2211/002* (2013.01); *C21D 2211/005* (2013.01); *C21D 2211/008* (2013.01)

(58) Field of Classification Search
CPC .. C21D 8/0263; C21D 8/0273; C21D 8/0426; C21D 8/0463; C21D 8/0473; C22C 38/00; C22C 38/02; C22C 38/04; C22C 38/06; C22C 38/48; C22C 38/50
USPC ..... 420/103
See application file for complete search history.

(56) References Cited

U.S. PATENT DOCUMENTS

| | | | | |
|---|---|---|---|---|
| 10,655,201 | B2 * | 5/2020 | Kariya | C22C 38/58 |
| 2013/0048151 | A1 * | 2/2013 | Kawamura | C21D 8/0257 148/333 |
| 2018/0057916 | A1 | 3/2018 | Obata et al. | |
| 2018/0057919 | A1 * | 3/2018 | Kariya | C22C 38/06 |
| 2018/0100212 | A1 | 4/2018 | Ono et al. | |
| 2018/0298462 | A1 | 10/2018 | Sano et al. | |
| 2019/0112682 | A1 | 4/2019 | Kohsaka et al. | |
| 2019/0127820 | A1 | 5/2019 | Hasegawa et al. | |
| 2019/0203317 | A1 | 7/2019 | Yoshioka et al. | |
| 2019/0382864 | A1 | 12/2019 | Cho et al. | |
| 2021/0310094 | A1 * | 10/2021 | Yoshioka | C22C 38/14 |

FOREIGN PATENT DOCUMENTS

| | | | |
|---|---|---|---|
| EP | 3178957 | A1 | 6/2017 |
| EP | 3556894 | A1 | 10/2019 |
| JP | 2010215958 | A | 9/2010 |
| JP | 4977879 | B2 | 7/2012 |
| JP | 5466576 | B2 | 4/2014 |
| JP | 6291289 | B2 | 3/2018 |
| KR | 20180074284 | A | 7/2018 |
| WO | 2011118459 | A1 | 9/2011 |
| WO | 2016078644 | A1 | 5/2016 |
| WO | 2016152163 | A1 | 9/2016 |
| WO | 2016199922 | A1 | 12/2016 |
| WO | 2017168961 | A1 | 10/2017 |
| WO | 2017169870 | A1 | 10/2017 |
| WO | 2018062381 | A1 | 4/2018 |
| WO | 2018117501 | A1 | 6/2018 |

OTHER PUBLICATIONS

Extended European Search Report for European Application No. 19 852 813.5, dated Apr. 9, 2021, 11 pages.
International Search Report and Written Opinion for International Application No. PCT/JP2019/022848, dated Sep. 3, 2019, 6 pages.
Edited by Cui, Z., "Metallurgy and Heat Treatment", Oct. 31, 1994, 16 pages, Harbin Institute of Technology, Published by China Machine Press (with English translation).
Chinese Office Action with Search Report for Chinese Application No. 201980054800.2, dated Aug. 25, 2021, 11 pages. 2021.

* cited by examiner

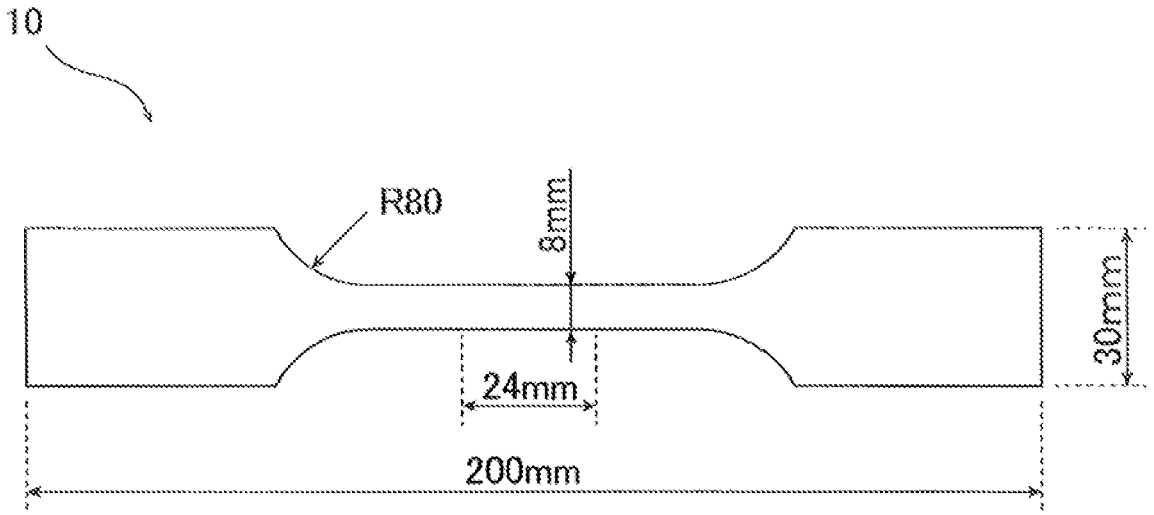
10
R80
8mm
30mm
24mm
200mm

HIGH-STRENGTH STEEL SHEET AND METHOD FOR MANUFACTURING SAME

CROSS REFERENCE TO RELATED APPLICATIONS

This is the U.S. National Phase application of PCT/JP2019/022848, filed Jun. 10, 2019 which claims priority to Japanese Patent Application No. 2018-155231, filed Aug. 22, 2018, the disclosures of these applications being incorporated herein by reference in their entireties for all purposes.

FIELD OF THE INVENTION

The present invention relates to a high-strength steel sheet suitable for cold press forming used after a cold press forming step in automobiles, home electrical appliances, etc., and a method for manufacturing the same.

BACKGROUND OF THE INVENTION

These days, the requirement of strength increase for steel sheets used for automotive framework parts increases more and more; in some framework parts, high-strength steel sheets with tensile strengths (hereinafter, also referred to as simply TS) of the class of more than 1320 MPa are coming into wide use. To obtain such an ultrahigh strength, it is effective to set the steel structure to contain a hard structure such as martensite or bainite as a main constituent. However, such a steel structure has a lower degree of elongation than multi-phase steel of ferrite and martensite, or the like; hence, parts for which such a structure is used are limited to parts that have relatively simple shapes and are molded by bending processing. Thus, excellent bendability is required to achieve strength increases of automotive parts by means of a steel structure containing martensite or bainite as a main constituent.

Conventionally, cracks in bend tests have been checked by visual inspection in many cases; however, in high tensile strength steel with a tensile strength of more than 1320 MPa, there is a concern that even a micro crack of 1 mm or less will degrade fatigue properties.

Patent Literature 1 proposes a method in which the distribution form of inclusions in a surface layer region extending up to (sheet thickness×0.1) in depth from a surface of a steel sheet is prescribed to improve bendability.

Patent Literature 2 proposes a method in which a soft portion with a hardness of 80% or less of the hardness of a central portion of a steel sheet is formed in a surface layer region of the steel sheet to improve bendability. Further, the literature mentions that a considerable degradation in fatigue properties can be suppressed by setting the soft portion of the surface layer to be a structure containing as little ferrite as possible.

PATENT LITERATURE

Patent Literature 1: JP 5466576 B2
Patent Literature 2: JP 4977879 B2

SUMMARY OF THE INVENTION

However, although the technology of Patent Literature 1 can suppress coarse cracks of a visible level that have started from inclusions, the technology fails to sufficiently suppress micro cracks of 1 mm or less formed in the very surface layer region of the steel sheet.

Further, it is known that the fatigue strength of a steel sheet is in proportion to the strength of the material; it is presumed that, in the technology according to Patent Literature 2, if the hardness of the surface layer region of the steel sheet is reduced to 80% or less of the strength of the base material, also the fatigue strength is significantly reduced.

The current situation is that a steel sheet that has a tensile strength of 1320 MPa or more and has achieved both excellent bendability and fatigue properties is not developed. Aspects of the present invention have been made in order to solve the point at issue mentioned above, and an object according to aspects of the present invention is to provide a high-strength steel sheet that is excellent in bendability and fatigue properties and has a tensile strength of 1320 MPa or more, and a method for manufacturing the same.

In accordance with aspects of the present invention, high strength means that the tensile strength (TS) is 1320 MPa or more.

The present inventors conducted extensive studies in order to solve the issue mentioned above. As a result, the present inventors have found that, in a high-strength steel sheet having a steel structure containing martensite and bainite as main constitutes, by adjusting the chemical composition to a specified range, adjusting the area fraction of ferrite in a region extending up to 10 μm from a surface to a specified range, and setting the hardness in a position of 15 μm in the sheet thickness direction from the surface to a predetermined hardness or more, bendability can be improved while excellent fatigue properties are provided.

More specifically, aspects of the present invention provide the following.

[1] A high-strength steel sheet including: a chemical composition containing, in mass %, C: 0.13% or more and less than 0.40%, Si: 0.01% or more and 1.0% or less, Mn: 1.7% or less (excluding 0%), P: 0.030% or less, S: 0.010% or less, Al: 0.20% or less (excluding 0%), N: 0.010% or less, and the balance being Fe and incidental impurities; and a steel structure in which a total area fraction of martensite and bainite in a position of ¼ of a sheet thickness is 95% or more and 100% or less, the balance in a case where the total area fraction is not 100% contains retained austenite, and an area fraction of ferrite in a region extending up to 10 μm in a sheet thickness direction from a surface is 10% or more and 40% or less, in which a tensile strength is 1320 MPa or more, and a Vickers hardness in a position of 15 μm in the sheet thickness direction from the surface satisfies a formula (1) below, $$Hv \geq 0.294 \times \sigma \quad (1)$$

where, Hv represents a Vickers hardness in the position of 15 μm in the sheet thickness direction from the surface, and σ represents a tensile strength (MPa).

[2] The high-strength steel sheet according to [1], in which the chemical composition further contains, in mass %, at least one of Mo: 0.005% or more and 0.3% or less, Cr: 0.01% or more and 1.0% or less, Nb: 0.001% or more and 0.10% or less, Ti: 0.001% or more and 0.10% or less, B: 0.0002% or more and 0.0050% or less, Sb: 0.001% or more and 0.1% or less, Ca: 0.0002% or more and 0.0040% or less, V: 0.003% or more and 0.45% or less, Cu: 0.005% or more and 0.50% or less, Ni: 0.005% or more and 0.50% or less, and Sn: 0.002% or more and 0.1% or less.

[3] A method for manufacturing a high-strength steel sheet, the method including: a continuous annealing step of, under a condition where a dew point in a temperature region of 750° C. or more is −35° C. or less, holding a cold rolled steel sheet having the chemical composition according to [1] or [2] at an annealing temperature of 840° C. or more for 180 seconds or more and cooling the cold rolled steel sheet at a cooling start temperature of 740° C. or more and at an average cooling rate of 100° C./s or more through a temperature region from the cooling start temperature to 150° C.; and an overaging treatment step of, after the continuous annealing step, performing reheating as necessary and performing holding in a temperature region of 150 to 260° C. for 30 to 1500 seconds.

According to aspects of the present invention, a high-strength steel sheet that has achieved both excellent bendability and fatigue properties, and a method for manufacturing the same can be provided.

BRIEF DESCRIPTION OF THE DRAWING

The FIGURE is a diagram showing a test piece for evaluating fatigue properties.

DETAILED DESCRIPTION OF EMBODIMENTS OF THE INVENTION

Hereafter, the embodiments of the present invention will be described. Here, the present invention is not limited to the embodiments described below. The "%" of the content amount of a composition means "mass %."

Further, in the following description, a region extending up to 10 μm in the sheet thickness direction from a surface of a steel sheet is also referred to as simply a surface layer region.

C: 0.13% or more and less than 0.40%

C is necessary to improve hardenability and to obtain a steel structure in which the total area fraction of martensite or bainite in a position of ¼ of the sheet thickness is 95% or more. Further, C is necessary from the viewpoint of raising the strength of martensite or bainite to ensure TS≥1320 MPa. If the content of C is less than 0.13%, a predetermined strength cannot be obtained. Thus, the content of C is set to 0.13% or more. From the viewpoint of obtaining TS≥1470 MPa, the content of C is preferably set to 0.15% or more. The content of C is more preferably 0.17% or more. If the content of C is 0.40% or more, it is difficult to obtain good weldability or delayed fracture resistance. Thus, the content of C is set to less than 0.40%. The content of C is preferably 0.35% or less, and more preferably 0.32% or less.

Si: 0.01% or more and 1.0% or less

Si is contained as a strengthening element based on solid solution strengthening, and is incorporated from the viewpoint of improving bendability by suppressing the generation of film-like carbides in the case where tempering is performed in the temperature region of 200° C. or more. From the viewpoint of obtaining the effects mentioned above, the content of Si is set to 0.01% or more. The content of Si is preferably 0.10% or more, and more preferably 0.20% or more. On the other hand, if the content of Si is too large, the amount of Si segregated is increased, and bendability is degraded. Further, if the content of Si is too large, a significant increase of the rolling load in hot rolling or cold rolling is caused. Thus, the content of Si is 1.0% or less. The content of Si is preferably 0.8% or less, and more preferably 0.6% or less.

Mn: 1.7% or less (excluding 0%)

Mn contributes to the effect of increasing the total area fraction of martensite and bainite through an increase in hardenability and to an improvement in strength by solid solution strengthening. Further, Mn is incorporated in order to fix S in the steel as MnS to reduce hot shortness. The lower limit of the content of Mn is not prescribed; however, to ensure a predetermined total area fraction of martensite and bainite in an industrially stable manner, Mn is preferably incorporated at 0.2% or more. The content of Mn is more preferably 0.5% or more, and still more preferably 0.7% or more. On the other hand, the content of Mn is set to 1.7% or less from the viewpoint of stability of the weldability. The content of Mn is preferably 1.6% or less, and more preferably 1.5% or less.

P: 0.030% or less

P is an element that strengthens the steel; however, if the content of P is large, spot weldability is significantly degraded. Thus, the content of P is set to 0.030% or less. From the viewpoint of sufficiently suppressing the degradation in spot weldability, the content of P is preferably set to 0.010% or less. The lower limit of the content of P is not prescribed; however, an industrially feasible lower limit is approximately 0.002% at present, and the content of P is in many cases substantially this value or more.

S: 0.010% or less

S has great influence on bendability and fatigue properties through the formation of MnS, etc. Hence, it is desirable to reduce the content of S. To reduce harmful effects due to inclusions, the content of S needs to be set to at least 0.010% or less. The lower limit of the content of S is not prescribed; however, an industrially feasible lower limit is approximately 0.0002% at present, and the content of S is in many cases substantially this value or more.

Al: 0.20% or less (excluding 0%)

Al is incorporated in order to make sufficient deoxidation to reduce the amount of in-steel inclusions. The lower limit of the content of Al is not particularly prescribed; however, to make deoxidation stably, the content of Al is preferably set to 0.01% or more. On the other hand, if the content of Al is more than 0.20%, it is feared that cementite generated during coiling is less likely to dissolve as solid solution in an annealing stage and bendability will be degraded. Thus, the content of Al is set to 0.20% or less.

N: 0.010% or less

N is an element that forms, in the steel, inclusions based on nitrides and carbonitrides such as TiN, (Nb, Ti)(C, N), and AlN, and degrades bendability and fatigue properties through the generation thereof. Therefore, the content of N needs to be set to at least 0.010% or less. The lower limit of the content of N is not prescribed; however, an industrially feasible lower limit is approximately 0.0006% at present, and the content of N is in many cases substantially this value or more.

The chemical composition of the steel sheet according to aspects of the present invention may contain, apart from the above basic components, at least any one of the following optional elements.

Nb: 0.001% or more and 0.10% or less

Nb contributes to a strength increase through making the internal construction of martensite or bainite finer. From the viewpoint of obtaining this effect, the content of Nb is set to 0.001% or more. The content of Nb is preferably 0.005% or more, and more preferably 0.008% or more. However, if the content of Nb is excessive, large amounts of inclusions such as NbC are generated, and bendability is degraded. In order to reduce such bad influence, the content of Nb is set to 0.10% or less. The content of Nb is preferably 0.08% or less, and more preferably 0.06% or less.

Ti: 0.001% or more and 0.10% or less

Ti contributes to a strength increase through making the internal construction of martensite or bainite finer. From the viewpoint of obtaining this effect, the content of Ti is set to 0.001% or more. The content of Nb is preferably 0.005% or more, and more preferably 0.008% or more. However, if the content of Ti is excessive, large amounts of inclusions such as TiN and TiC are generated, and bendability is degraded. In order to reduce such bad influence, the content of Ti is set to 0.10% or less. The content of Ti is preferably 0.06% or less, and more preferably 0.03% or less.

B: 0.0002% or more and 0.0050% or less

B is an element that improves the hardenability of the steel, and has an advantage that it allows even a small content of Mn to generate martensite or bainite at a predetermined area fraction. To obtain such an effect of B, the content of B is set to 0.0002% or more. The content of B is preferably 0.0005% or more, and more preferably 0.0010% or more. On the other hand, if B is contained at more than 0.0050%, not only this effect saturates, but also the dissolution rate of cementite at the time of annealing is reduced, and cementite not dissolving as solid solution is caused to remain and consequently bendability is degraded. Thus, the content of B is set to 0.0050% or less. The content of B is preferably 0.0040% or less, and more preferably 0.0030% or less.

Cu: 0.005% or more and 0.50% or less

Cu improves corrosion resistance in automotive operating environments. Cu is an element that gets mixed in when scrap is utilized as a raw material; by permitting the mixing-in of Cu, recycling materials can be utilized as materials for a source material, and the manufacturing cost can be reduced. The content of Cu is set to 0.005% or more from the viewpoint mentioned above. The content of Cu is preferably 0.010% or more, and more preferably 0.050% or more. However, too large a content of Cu is a cause of surface defects; thus, the content of Cu is set to 0.50% or less. The content of Cu is preferably 0.40% or less, and more preferably 0.30% or less.

Ni: 0.005% or more and 0.50% or less

Also Ni is an element having the action of improving corrosion resistance. Further, Ni has the action of reducing the amount of surface defects that are likely to occur in the case where Cu is incorporated. From the viewpoint of obtaining the effects mentioned above, the content of Ni is set to 0.005% or more. The content of Ni is preferably 0.008% or more, and more preferably 0.010% or more. However, too large a content of Ni brings about non-uniform generation of scales in a heating furnace and is a cause of surface defects, and leads to a significant cost increase. Thus, the content of Ni is set to 0.50% or less. The content of Ni is preferably 0.20% or less, and more preferably 0.15% or less.

Cr: 0.01% or more and 1.0% or less

Cr may be added in order to obtain the effect of improving the hardenability of the steel. To obtain this effect, the content of Cr is set to 0.01% or more. The content of Cr is preferably 0.03% or more, and more preferably 0.05% or more. If the content of Cr is more than 1.0%, the dissolution rate of cementite at the time of annealing is reduced, and cementite not dissolving as solid solution is caused to remain and consequently bendability is degraded. Further, pitting corrosion resistance is also degraded. In addition, chemical convertibility is also degraded. Thus, the content of Cr is set to 1.0% or less.

Mo: 0.005% or more and 0.3% or less

Mo may be added for the purpose of obtaining the effect of improving the hardenability of the steel and the effect of increasing strength by making martensite finer. To obtain these effects, the content of Mo is set to 0.005% or more. The content of Mo is preferably 0.010% or more, and more preferably 0.040% or more. However, if Mo is contained at more than 0.3%, chemical convertibility is degraded. Thus, the content of Mo is set to 0.3% or less. The content of Mo is preferably 0.2% or less, and more preferably 0.1% or less.

V: 0.003% or more and 0.45% or less

V may be added for the purpose of obtaining the effect of improving the hardenability of the steel, the effect of generating V-containing fine carbides serving as hydrogen trapping sites, and the effect of improving delayed fracture resistance by making martensite finer. To obtain these effects, the content of V is set to 0.003% or more. The content of V is preferably 0.005% or more, and more preferably 0.010% or more. However, if V is contained at more than 0.45%, castability is significantly degraded. Thus, the content of V is set to 0.45% or less. The content of V is preferably 0.30% or less, and more preferably 0.20% or less.

Ca: 0.0002% or more and 0.0040% or less

Ca fixes S as CaS, and improves bendability. To obtain this effect, the content of Ca is set to 0.0002% or more. The content of Ca is preferably 0.0003% or more, and more preferably 0.0004% or more. However, if a large amount of Ca is added, surface quality and bendability are degraded; thus, the content of Ca is set to 0.0040% or less. The content of Ca is preferably 0.0036% or less, and more preferably 0.0032% or less.

Sb: 0.001% or more and 0.1% or less

Sb suppresses oxidation and nitriding in the surface layer region of the steel sheet, and suppresses the reduction in the content in the surface layer region of C and/or B caused by oxidation or nitriding. By the reduction in the amount of C and/or B being suppressed, the generation of ferrite in the surface layer region is suppressed, and a contribution is made to a strength increase and an improvement in fatigue properties. From the viewpoint of obtaining this effect, the content of Sb is set to 0.001% or more. The content of Sb is preferably 0.002% or more, and more preferably 0.005% or more. However, if the content of Sb is more than 0.1%, castability is degraded, and Sb is segregated at prior γ grain boundaries and bendability is degraded. Thus, the content of Sb is set to 0.1% or less. The content of Sb is preferably 0.04% or less.

Sn: 0.002% or more and 0.1% or less

Sn suppresses oxidation and nitriding in the surface layer region of the steel sheet, and suppresses the reduction in the content in the surface layer region of C and/or B caused by oxidation or nitriding. By the reduction in the amount of C and/or B being suppressed, the generation of ferrite in the surface layer region is suppressed, and a contribution is made to a strength increase and an improvement in fatigue properties. From the viewpoint of obtaining this effect, the content of Sn is set to 0.002% or more. The content of Sn is preferably 0.005% or more. However, if the content of Sn is more than 0.1%, castability is degraded, and Sn is segregated at prior austenite grain boundaries and bendability is degraded. Thus, the content of Sn is set to 0.1% or less. The content of Sn is preferably 0.04% or less.

The balance other than the above is Fe and incidental impurities. In the case where any of the optional elements mentioned above is contained at less than the lower limit value, it is assumed that the optional element is contained as an incidental impurity.

Next, the prescription of the steel structure of the high-strength steel sheet according to aspects of the present invention is described.

Area fraction of martensite and bainite in a position of ¼ of the sheet thickness being 95% or more and 100% or less in total In order to achieve a high strength of TS≥1320 MPa, the steel structure is set such that the total area fraction of martensite and bainite in a position of ¼ of the sheet thickness is 95% or more. The total area fraction is preferably 97% or more, and more preferably 98% or more. The balance contained in the case where the total area fraction is not 100% is retained austenite, etc. The retained austenite is what remains in a cooling stage of an annealing step, and can be permitted up to an area fraction of 5%. The rest other than the above structure is very small amounts of ferrite, pearlite, sulfides, nitrides, oxides, etc., and these account for 5% or less in terms of area fraction. Instead of containing balance, the total area fraction of martensite and bainite may be 100%. The area fraction mentioned above is measured by a method described in Examples.

Area fraction of ferrite in a region extending up to 10 μm in the sheet thickness direction from the surface of the steel sheet (the surface layer region) being 10% or more and 40% or less In order to suppress micro cracks of 1 mm or less occurring during bending processing, 10% or more and 40% or less ferrite in terms of area fraction is incorporated in the surface layer region of the steel sheet. To obtain this effect, the area fraction of ferrite needs to be 10% or more. The area fraction of ferrite is preferably 13% or more, and more preferably 16% or more. Further, if ferrite is contained at an area fraction of more than 40%, fatigue properties are degraded. Thus, the area fraction of ferrite mentioned above is set to 40% or less. The area fraction of ferrite is preferably 35% or less, and more preferably 30% or less. Further, as is clear from the constitution represented by a formula (1) described later, both bendability and fatigue properties can be achieved by softening only a region extending up to 10 μm. Thus, the area fraction of ferrite in the surface layer region is set to 10% or more and 40% or less. To thus form a very small amount of ferrite only in the surface layer region of the steel sheet, the control of the dew point and the control of the annealing temperature in continuous annealing described later are important. The area fraction mentioned above is measured by a method described in Examples.

In accordance with aspects of the present invention, when the area fraction of ferrite in a region extending up to 10 μm in the sheet thickness direction from the surface of the steel sheet (the surface layer region) is adjusted to 10% or more and 40% or less, the balance other than ferrite in this region may be any structure. As the balance other than ferrite, martensite, bainite, retained austenite, etc. are given.

The Vickers hardness in a position of 15 μm in the sheet thickness direction from the surface of the steel sheet satisfies a formula (1) below.

$$Hv \geq 0.294 \times \sigma \quad (1)$$

Here, Hv represents the Vickers hardness in a position of 15 μm in the sheet thickness direction from the surface of the steel sheet, and σ represents the tensile strength (MPa). The Vickers hardness and the tensile strength mentioned above are measured by methods described in Examples.

As mentioned above, excellent bendability can be achieved by softening the surface layer region of the steel sheet; however, fatigue properties are remarkably degraded by the softening. In order to suppress this bad influence, the hardness at least in a position of 15 μm in the sheet thickness direction from the surface is maintained at a certain level or more; thereby, both excellent fatigue properties and bendability can be achieved. The hardness of a part more on the center side in the sheet thickness direction than the position of 15 μm in the sheet thickness direction from the surface of the steel sheet is higher because there is little decarburization or deboronization. It is feared that the residual stress on the steel sheet that occurs during press forming or fixing to an automotive body will be increased with the strength increase of the steel sheet; hence, higher fatigue strength is demanded in association with the increase in the strength of the steel sheet. When the hardness mentioned above is controlled in accordance with the strength of the steel sheet itself as prescribed in the formula (1), excellent fatigue properties are obtained. In order to thus soften the surface layer region of the steel sheet and yet keep a part immediately below it at a certain hardness or more, the control of the dew point and the control of the annealing temperature in continuous annealing described later are important.

Next, a method for manufacturing a steel sheet suitable in accordance with aspects of the present invention is described. In accordance with aspects of the present invention, a high-strength steel sheet is preferably manufactured by a method in which a slab obtained by continuous casting is used as a steel raw material, and the slab is subjected to hot rolling and finish rolling, is cooled after the finish rolling is ended, is wound in a coil, is subsequently pickled, is then cold rolled, and is then subjected to continuous annealing and overaging treatment.

In the manufacturing method according to aspects of the present invention, the conditions of the steps up to cold rolling may be common conditions. Conditions employed in the continuous annealing step and the overaging treatment step will now be described. In the following description, the temperature is the temperature of a surface of the steel sheet.

The continuous annealing step is a step of, under a condition where a dew point in a temperature region of 750° C. or more is −35° C. or less, holding the cold rolled steel sheet having the chemical composition described above at an annealing temperature of 840° C. or more for 180 seconds or more and cooling the cold rolled steel sheet at a cooling start temperature of 740° C. or more and at an average cooling rate of 100° C./s or more through a temperature region from the cooling start temperature to 150° C.

If the annealing temperature is less than 840° C., it is feared that austenite (which transforms into martensite or bainite after quenching) necessary to ensure a predetermined strength will not be formed during the annealing and a tensile strength of 1320 MPa or more cannot be obtained even if quenching is performed after the annealing. Thus, the annealing temperature is set to 840° C. or more. From the viewpoint of ensuring an equilibrium area fraction of austenite of 40% or more stably, the annealing temperature is preferably set to 850° C. or more. Further, decarburization and deboronization have occurred in the vicinity of the surface layer of the steel sheet; to ensure austenite stably and keep Hv mentioned above at a certain level or more, the annealing temperature needs to be 840° C. or more. Although the upper limit of the annealing temperature is not particularly limited, the annealing temperature is preferably 900° C. or less because the austenite grain size may become coarse and the toughness may deteriorate.

If the hold time of the annealing temperature is too short, annealing is insufficient, and it is feared that a non-uniform structure in which a processing structure based on cold rolling exists will be produced and strength and processability will be reduced. Thus, the hold time of the annealing temperature is set to 180 seconds or more. Although the upper limit of the hold time at annealing is not particularly limited, the hold time is preferably 600 seconds or less because the austenite grain size may become coarse and the toughness may deteriorate.

To suppress the formation of ferrite to ensure the area fraction of martensite or bainite, it is necessary to perform cooling at a cooling start temperature of 740° C. or more and at an average cooling rate of 100° C./s or more through the temperature region from the cooling start temperature to 150° C. If the cooling start temperature is lower than the value mentioned above or the average cooling rate is slower than the value mentioned above, ferrite and retained austenite are formed in surplus, and a strength reduction and degradation in fatigue properties are caused. The upper limit of the average cooling rate in the temperature region from the cooling start temperature to 150° C. is not particularly limited, but is preferably 1500° C./s or less from the viewpoint of energy saving because the effect saturates even the upper limit is set to over 1500° C./s. The cooling start temperature is not particularly prescribed; however, since the lower limit of the annealing temperature is 840° C., the cooling start temperature is substantially 840° C. or less. The average cooling rate from 150° C. to the cooling stop temperature is not particularly limited.

In the continuous annealing step, the dew point in the temperature region of 750° C. or more is controlled to −35° C. or less. If the dew point is higher than this, ferrite is formed in surplus in the surface layer region of the steel sheet, and hardness is reduced. The lower limit of the dew point is not particularly prescribed, but is preferably set to −60° C. from the viewpoint of manufacturing cost.

The overaging treatment step is a step of, after the continuous annealing step, performing reheating as necessary, and performing holding in the temperature region of 150 to 260° C. for 30 to 1500 seconds.

The carbides distributed in the interior of martensite or bainite are carbides formed during the holding of a low temperature region after quenching, and need to be appropriately controlled in order to ensure bendability and TS≥1320 MPa. That is, it is necessary that, after the continuous annealing step, reheating be performed from a temperature of 150° C. or less to a temperature region of 150 to 260° C. as necessary and holding be performed in the temperature region for 30 to 1500 seconds.

It is also necessary to control the hold time to 30 to 1500 seconds. If the holding temperature is less than 150° C. or the hold time is less than 30 seconds, it is feared that the density of carbides distributed will be insufficient and toughness will be degraded. On the other hand, if the holding temperature is more than 260° C. or the hold time is more than 1500 seconds, the coarsening of carbides in the grain and at the block boundary is conspicuous, and bendability is degraded.

EXAMPLES

Hereinbelow, Examples of the present invention are described.

A piece of test sample steel composed of each of the chemical compositions written in Table 1 (the balance being Fe and incidental impurities) was subjected to vacuum smelting into a slab; then, the slab was heated at a temperature of 1200 to 1280° C., was then hot rolled at a finish rolling delivery temperature of 840° C. to 950° C., and was coiled at a coiling temperature of 450° C. to 650° C. The resulting hot rolled steel sheet was subjected to pickling treatment to remove surface scales, and was then cold rolled at a rolling reduction ratio of 40% or more. Next, continuous annealing and overaging treatment were performed under the conditions written in Table 2. After that, temper rolling at 0.1% was performed, and a steel sheet was obtained.

The "–" of Table 1 includes not only the case where optional elements are not contained (0 mass %) but also the case where optional elements are contained as incidental impurities at less than the respective lower limit values.

A test piece was extracted from the steel sheet obtained in the above manner, and the observation of steel structures, a tensile test, a Vickers hardness test, a bending test, and a fatigue test were performed. The results of these are shown in Table 3.

The observation of steel structures was performed as follows: a cross section parallel to the rolling direction was subjected to mechanical polishing and nital etching, and then four fields of view were observed with a scanning electron microscope (SEM) in each of a surface layer region of the steel sheet (only ferrite was measured in a region extending up to 10 μm in the sheet thickness direction from a surface of the steel sheet) and a position of one fourth of the sheet thickness. The area fraction of each structure was found by performing image analysis on a SEM image at a magnification of 2000 times. The area fraction was found by averaging the area fractions found in the four fields of view. Here, martensite, bainite, and retained austenite represent structures exhibiting gray in the SEM. On the other hand, ferrite is a region exhibiting a contrast of black in the SEM. The area fraction of retained austenite was found as follows: taking a sheet surface as the object to be observed, processing was performed by mechanical grinding and chemical polishing up to a thickness of one fourth of the sheet thickness, then the volume fraction was found by the X-ray diffraction method, and the volume fraction was regarded as the area fraction. In this measurement, calculation is made from the integrated intensity ratios of the peaks of the (200)α, (211)α, (220)α, (200)γ, (220)γ, and (311)γ diffraction planes measured with a Mo—$K_\alpha$ line. In the case where there were no balance structures (for example, pearlite, sulfides, nitrides, oxides, etc.), the sum total of the area fractions of martensite and bainite was found as the balance other than the total area fraction of ferrite and retained austenite. In the case where there were balance structures, the sum total of the area fractions of martensite and bainite was calculated by using the sum total of ferrite, retained austenite, and the balance structures.

The tensile test was performed as follows: in a position of one fourth of the sheet width of the steel sheet, a tensile test piece of JIS No. 5 was cut out such that a direction at a right angle to the rolling direction in the surface of the steel sheet was set as the longitudinal direction; and a tensile test (JIS Z2241) was performed. The yield strength (YS), the tensile strength (TS), and the elongation (El) were measured by the tensile test.

The Vickers hardness test was performed as follows: a microhardness meter (HM-200, manufactured by Mitutoyo Corporation) was used to measure 10 positions of 15 μm from the surface of the steel sheet under the condition of an indenter load of 10 g, and the average value was found.

The bending test was performed as follows: in a position of one fourth of the sheet width of the steel sheet, a strip-like test piece extending 100 mm in a direction at a right angle to the rolling direction and 35 mm in the rolling direction in the surface of the steel sheet was cut out; and a bending test was performed by using a jig with an interior angle of the tip of 90 degrees. The radius of curvature of the interior angle of the tip of the jig was changed, the smallest interior angle of the tip of the jig among those in which a crack was not seen on the surface of the test piece was found, and the obtained radius (R) was divided by the sheet thickness (t); thereby, the limit bending radius (R/t) was calculated. The smaller the value is, the more excellent bendability the test piece has. The assessment of a crack was performed with a magnification of 20 times at the maximum by using a stereoscopic microscope and measuring the length of a crack. For micro cracks of less than 0.1 mm, it was hard for the stereoscopic microscope to distinguish such cracks from the unevenness of the surface; hence, a crack of 0.1 mm or more was assessed as a breakage.

The fatigue properties were evaluated by a pulsating tensile fatigue test. A test piece 10 of the shape shown in the FIGURE was cut out such that a direction at a right angle to the rolling direction in the surface of the steel sheet was set as the longitudinal direction, and a pulsating tensile fatigue test was performed while the stress ratio was set to 0.1, the frequency was set to 20 Hz, and the number of repetitions was set to ten million at the maximum. In the FIGURE, the left and right direction on the drawing sheet corresponds to the rolling direction of the steel sheet, and R80 means that a curvature radius is 80 mm. A type of Servopet Lab manufactured by Shimadzu Corporation was used as the test machine. The maximum load stress among those by which breaking did not occur after ten million times of repetition was taken as the fatigue strength. An endurance ratio was calculated as a value obtained by dividing the fatigue strength by the tensile strength of the material, and was used as an index of fatigue properties.

Each of the steel sheets of Present Invention Examples has a tensile strength of 1320 MPa or more, an excellent bendability of 3.0 or less in terms of R/t, and an excellent fatigue property of 0.50 or more in terms of endurance ratio.

In the steel sheets of Comparative Examples, at least one of these conditions is not satisfied.

TABLE 1

| | Steel | Chemical compositions (mass %) | | | | | | | | | | |
|---|---|---|---|---|---|---|---|---|---|---|---|---|
| No. | No. | C | Si | Mn | P | S | Al | N | Cu | Ni | Nb | Ti |
| 1 | A | 0.14 | 0.42 | 1.7 | 0.014 | 0.0009 | 0.033 | 0.0044 | — | — | — | — |
| 2 | B | 0.38 | 0.63 | 1.2 | 0.010 | 0.0004 | 0.028 | 0.0040 | — | — | — | — |
| 3 | C | 0.18 | 0.95 | 1.5 | 0.012 | 0.0010 | 0.060 | 0.0035 | — | — | — | — |
| 4 | D | 0.24 | 0.22 | 1.0 | 0.008 | 0.0008 | 0.180 | 0.0050 | — | — | — | — |
| 5 | E | 0.26 | 0.56 | 0.4 | 0.016 | 0.0015 | 0.040 | 0.0040 | — | — | — | — |
| 6 | F | 0.16 | 0.41 | 1.6 | 0.010 | 0.0008 | 0.032 | 0.0038 | 0.30 | 0.16 | — | — |
| 7 | G | 0.15 | 0.50 | 1.5 | 0.016 | 0.0010 | 0.030 | 0.0041 | 0.12 | 0.05 | 0.010 | 0.018 |
| 8 | H | 0.17 | 0.33 | 1.6 | 0.015 | 0.0011 | 0.028 | 0.0038 | 0.10 | 0.04 | 0.008 | 0.018 |
| 9 | I | 0.19 | 0.52 | 1.5 | 0.008 | 0.0008 | 0.050 | 0.0040 | 0.18 | 0.08 | 0.012 | 0.012 |
| 10 | J | 0.17 | 0.46 | 1.5 | 0.012 | 0.0020 | 0.038 | 0.0045 | 0.06 | 0.01 | 0.050 | — |
| 11 | K | 0.22 | 0.53 | 1.7 | 0.010 | 0.0011 | 0.028 | 0.0042 | 0.11 | 0.03 | 0.010 | 0.016 |
| 12 | L | 0.12 | 0.41 | 1.3 | 0.010 | 0.0010 | 0.039 | 0.0040 | — | — | — | — |
| 13 | M | 0.18 | 1.20 | 1.5 | 0.008 | 0.0008 | 0.032 | 0.0036 | — | — | — | — |
| 14 | N | 0.22 | 0.45 | 1.2 | 0.014 | 0.0110 | 0.035 | 0.0041 | — | — | — | — |
| 15 | O | 0.23 | 0.32 | 1.4 | 0.012 | 0.0006 | 0.252 | 0.0045 | — | — | — | — |
| 16 | C | 0.18 | 0.95 | 1.5 | 0.012 | 0.0010 | 0.060 | 0.0035 | — | — | — | — |
| 17 | C | 0.18 | 0.95 | 1.5 | 0.012 | 0.0010 | 0.060 | 0.0035 | — | — | — | — |
| 18 | C | 0.18 | 0.95 | 1.5 | 0.012 | 0.0010 | 0.060 | 0.0035 | — | — | — | — |
| 19 | C | 0.18 | 0.95 | 1.5 | 0.012 | 0.0010 | 0.060 | 0.0035 | — | — | — | — |
| 20 | C | 0.18 | 0.95 | 1.5 | 0.012 | 0.0010 | 0.060 | 0.0035 | — | — | — | — |
| 21 | A | 0.14 | 0.42 | 1.7 | 0.014 | 0.0009 | 0.033 | 0.0044 | — | — | — | — |
| 22 | A | 0.14 | 0.42 | 1.7 | 0.014 | 0.0009 | 0.033 | 0.0044 | — | — | — | — |
| 23 | P | 0.21 | <0.01 | 1.6 | 0.009 | 0.0006 | 0.032 | 0.0045 | — | — | — | — |
| 24 | Q | 0.26 | 0.10 | 1.3 | 0.010 | 0.0005 | 0.034 | 0.0042 | — | — | — | — |
| 25 | R | 0.36 | 0.80 | 0.1 | 0.012 | 0.0004 | 0.045 | 0.0038 | — | — | — | — |
| 26 | S | 0.23 | 0.46 | 1.5 | 0.028 | 0.0006 | 0.042 | 0.0045 | — | — | — | — |
| 27 | T | 0.32 | 0.33 | 1.6 | 0.006 | 0.0010 | 0.035 | 0.0105 | — | — | — | — |
| 28 | A | 0.14 | 0.42 | 1.7 | 0.014 | 0.0009 | 0.033 | 0.0044 | — | — | — | — |
| 29 | A | 0.14 | 0.42 | 1.7 | 0.014 | 0.0009 | 0.033 | 0.0044 | — | — | — | — |

| | Chemical compositions (mass %) | | | | | | | AC1 | |
|---|---|---|---|---|---|---|---|---|---|
| No. | V | Mo | Cr | B | Ca | Sn | Sb | (° C.) | Remarks |
| 1 | — | — | — | — | — | — | — | 717 | Conforming steel |
| 2 | — | — | — | — | — | — | — | 728 | Conforming steel |
| 3 | — | — | — | — | — | — | — | 735 | Conforming steel |
| 4 | — | — | — | — | — | — | — | 719 | Conforming steel |
| 5 | — | — | — | — | — | — | — | 735 | Conforming steel |
| 6 | 0.02 | — | — | — | — | — | — | 715 | Conforming steel |
| 7 | — | — | — | 0.0018 | 0.0003 | — | — | 721 | Conforming steel |
| 8 | 0.01 | — | — | 0.0015 | — | — | — | 715 | Conforming steel |
| 9 | — | 0.08 | 0.60 | 0.0016 | — | — | — | 731 | Conforming steel |
| 10 | — | — | — | 0.0020 | 0.0022 | — | — | 721 | Conforming steel |
| 11 | — | — | — | 0.0022 | 0.0004 | 0.010 | 0.007 | 720 | Conforming steel |
| 12 | — | — | — | — | — | — | — | 721 | Non-conforming steel |
| 13 | — | — | — | — | — | — | — | 742 | Non-conforming steel |
| 14 | — | — | — | — | — | — | — | 723 | Non-conforming steel |
| 15 | — | — | — | — | — | — | — | 717 | Non-conforming steel |
| 16 | — | — | — | — | — | — | — | 735 | Conforming steel |
| 17 | — | — | — | — | — | — | — | 735 | Conforming steel |

TABLE 1-continued

| | | | | | | | | | |
|---|---|---|---|---|---|---|---|---|---|
| 18 | — | — | — | — | — | — | — | 735 | Conforming steel |
| 19 | — | — | — | — | — | — | — | 735 | Conforming steel |
| 20 | — | — | — | — | — | — | — | 735 | Conforming steel |
| 21 | — | — | — | — | — | — | — | 717 | Conforming steel |
| 22 | — | — | — | — | — | — | — | 717 | Conforming steel |
| 23 | — | — | — | — | — | — | — | 706 | Non-conforming steel |
| 24 | — | — | — | — | — | — | — | 712 | Conforming steel |
| 25 | — | — | — | — | — | — | — | 745 | Conforming steel |
| 26 | — | — | — | — | — | — | — | 720 | Conforming steel |
| 27 | — | — | — | — | — | — | — | 715 | Non-conforming steel |
| 28 | — | — | — | — | — | — | — | 717 | Conforming steel |
| 29 | — | — | — | — | — | — | — | 717 | Conforming steel |

TABLE 2

| | | Continuous annealing condition | | | | | Overaging treatment condition | | |
|---|---|---|---|---|---|---|---|---|---|
| No. | Steel No. | Annealing temperature (° C.) | Soaking time (s) | *1 (° C.) | Cooling start temperature (° C.) | Cooling rate (° C./s) | Holding temperature (° C.) | Hold time (s) | Remarks |
| 1 | A | 870 | 300 | −40 | 750 | 1000 | 160 | 600 | Invention Example |
| 2 | B | 860 | 300 | −38 | 750 | 1000 | 250 | 600 | Invention Example |
| 3 | C | 850 | 300 | −44 | 740 | 1000 | 220 | 600 | Invention Example |
| 4 | D | 840 | 300 | −48 | 740 | 1000 | 180 | 600 | Invention Example |
| 5 | E | 860 | 320 | −46 | 760 | 800 | 170 | 640 | Invention Example |
| 6 | F | 865 | 320 | −44 | 760 | 800 | 180 | 640 | Invention Example |
| 7 | G | 880 | 320 | −39 | 770 | 800 | 200 | 640 | Invention Example |
| 8 | H | 875 | 360 | −38 | 760 | 1000 | 190 | 720 | Invention Example |
| 9 | I | 870 | 360 | −41 | 760 | 1000 | 210 | 720 | Invention Example |
| 10 | J | 865 | 360 | −44 | 750 | 1000 | 180 | 720 | Invention Example |
| 11 | K | 850 | 360 | −38 | 740 | 1000 | 180 | 720 | Invention Example |
| 12 | L | 870 | 300 | −36 | 760 | 1100 | 160 | 600 | Comparative Example |
| 13 | M | 865 | 300 | −42 | 765 | 1100 | 200 | 600 | Comparative Example |
| 14 | N | 885 | 300 | −38 | 765 | 1100 | 160 | 600 | Comparative Example |
| 15 | O | 875 | 360 | −39 | 760 | 200 | 170 | 720 | Comparative Example |
| 16 | C | 830 | 360 | −48 | 770 | 250 | 180 | 720 | Comparative Example |
| 17 | C | 860 | 160 | −37 | 760 | 1000 | 180 | 320 | Comparative Example |
| 18 | C | 880 | 240 | −32 | 750 | 1000 | 160 | 480 | Comparative Example |
| 19 | C | 875 | 240 | −36 | 730 | 1000 | 160 | 480 | Comparative Example |
| 20 | C | 875 | 240 | −40 | 745 | 40 | 200 | 480 | Comparative Example |
| 21 | A | 865 | 300 | −41 | 780 | 1200 | 280 | 480 | Comparative Example |
| 22 | A | 865 | 300 | −38 | 780 | 1200 | 200 | 1800 | Comparative Example |
| 23 | P | 875 | 320 | −36 | 760 | 1000 | 240 | 640 | Comparative Example |
| 24 | Q | 880 | 360 | −40 | 770 | 1200 | 200 | 720 | Invention Example |
| 25 | R | 890 | 360 | −36 | 810 | 1200 | 180 | 720 | Invention Example |
| 26 | S | 860 | 320 | −39 | 780 | 900 | 175 | 640 | Invention Example |
| 27 | T | 880 | 320 | −37 | 770 | 900 | 190 | 640 | Comparative Example |
| 28 | A | 865 | 300 | −38 | 740 | 900 | 190 | 600 | Invention Example |
| 29 | A | 890 | 300 | −55 | 800 | 1200 | 270 | 600 | Comparative Example |

*1: A dew point in a temperature region of 750° C. or more

TABLE 3

| | | An area fraction of each steel sheet structure in a position of ¼ of a sheet thickness | | | | | | Mechanical property | | | | Fatigue property | | |
|---|---|---|---|---|---|---|---|---|---|---|---|---|---|---|
| No. | Steel No. | Martensite + bainite (%) | Retained austenite (%) | The balance Structure (%) | *1 (%) | *2 Hv | Hv/TS | YS (MPa) | TS (MPa) | El (%) | R/t | Fatigue strength (MPa) | Endurance ratio | Remarks |
| 1 | A | 99 | 1 | 0 | 27 | 464 | 0.343 | 1160 | 1354 | 7 | 2.9 | 850 | 0.63 | Invention Example |
| 2 | B | 98 | 2 | 0 | 38 | 685 | 0.349 | 1682 | 1963 | 6 | 2.9 | 1000 | 0.51 | Invention Example |
| 3 | C | 99 | 1 | 0 | 33 | 498 | 0.344 | 1240 | 1447 | 7 | 2.5 | 900 | 0.62 | Invention Example |
| 4 | D | 99 | 1 | 0 | 29 | 551 | 0.346 | 1365 | 1593 | 7 | 2.5 | 950 | 0.60 | Invention Example |
| 5 | E | 99 | 1 | 0 | 14 | 582 | 0.347 | 1420 | 1680 | 6 | 2.9 | 1025 | 0.61 | Invention Example |
| 6 | F | 99 | 1 | 0 | 16 | 478 | 0.343 | 1174 | 1393 | 7 | 2.9 | 875 | 0.63 | Invention Example |
| 7 | G | 99 | 1 | 0 | 16 | 469 | 0.343 | 1153 | 1368 | 7 | 2.9 | 850 | 0.62 | Invention Example |
| 8 | H | 99 | 1 | 0 | 25 | 490 | 0.344 | 1223 | 1427 | 7 | 2.5 | 875 | 0.61 | Invention Example |
| 9 | I | 99 | 1 | 0 | 21 | 516 | 0.345 | 1282 | 1496 | 7 | 2.5 | 925 | 0.62 | Invention Example |

TABLE 3-continued

| No. | Steel No. | An area fraction of each steel sheet structure in a position of ¼ of a sheet thickness: Martensite + bainite (%) | Retained austenite (%) | The balance Structure (%) | *1 (%) | *2 Hv | Hv/TS | Mechanical property: YS (MPa) | TS (MPa) | El (%) | R/t | Fatigue property: Fatigue strength (MPa) | Endurance ratio | Remarks |
|---|---|---|---|---|---|---|---|---|---|---|---|---|---|---|
| 10 | J | 99 | 1 | 0 | 20 | 502 | 0.344 | 1249 | 1458 | 7 | 2.5 | 950 | 0.65 | Invention Example |
| 11 | K | 99 | 1 | 0 | 20 | 558 | 0.346 | 1382 | 1613 | 6 | 2.5 | 1000 | 0.62 | Invention Example |
| 12 | L | 99 | 1 | 0 | 33 | 441 | 0.341 | 1116 | 1290 | 7 | 2.1 | 600 | 0.47 | Comparative Example |
| 13 | M | 99 | 1 | 0 | 19 | 517 | 0.345 | 1296 | 1500 | 7 | 3.9 | 975 | 0.65 | Comparative Example |
| 14 | N | 99 | 1 | 0 | 17 | 550 | 0.346 | 1373 | 1591 | 7 | 4.6 | 750 | 0.47 | Comparative Example |
| 15 | O | 99 | 1 | 0 | 23 | 554 | 0.346 | 1292 | 1601 | 7 | 3.6 | 1000 | 0.62 | Comparative Example |
| 16 | C | 26 | 4 | 70 | 80 | 144 | 0.176 | 624 | 816 | 19 | 1.8 | 400 | 0.49 | Comparative Example |
| 17 | C | 63 | 2 | 35 | 37 | 177 | 0.176 | 861 | 1005 | 16 | 2.5 | 475 | 0.47 | Comparative Example |
| 18 | C | 99 | 1 | 0 | 41 | 528 | 0.345 | 1312 | 1531 | 7 | 2.1 | 750 | 0.49 | Comparative Example |
| 19 | C | 94 | 1 | 5 | 42 | 428 | 0.279 | 1312 | 1531 | 7 | 2.1 | 750 | 0.49 | Comparative Example |
| 20 | C | 58 | 6 | 36 | 100 | 198 | 0.176 | 864 | 1120 | 12 | 1.8 | 500 | 0.45 | Comparative Example |
| 21 | A | 99 | 1 | 0 | 16 | 407 | 0.340 | 1046 | 1197 | 9 | 3.9 | 750 | 0.63 | Comparative Example |
| 22 | A | 99 | 1 | 0 | 23 | 448 | 0.342 | 1142 | 1309 | 8 | 3.6 | 800 | 0.61 | Comparative Example |
| 23 | P | 99 | 1 | 0 | 30 | 487 | 0.344 | 1215 | 1418 | 7 | 3.6 | 850 | 0.60 | Comparative Example |
| 24 | Q | 99 | 1 | 0 | 13 | 562 | 0.346 | 1411 | 1623 | 7 | 2.9 | 950 | 0.59 | Invention Example |
| 25 | R | 95 | 1 | 4 | 1 | 655 | 0.349 | 1630 | 1879 | 9 | 2.5 | 950 | 0.51 | Invention Example |
| 26 | S | 99 | 1 | 0 | 24 | 557 | 0.346 | 1371 | 1611 | 7 | 2.9 | 900 | 0.56 | Invention Example |
| 27 | T | 99 | 1 | 0 | 21 | 645 | 0.348 | 1576 | 1851 | 7 | 3.9 | 950 | 0.51 | Comparative Example |
| 28 | A | 95 | 1 | 4 | 39 | 394 | 0.298 | 1124 | 1323 | 8 | 2.5 | 675 | 0.51 | Invention Example |
| 29 | A | 99 | 1 | 0 | 5 | 412 | 0.340 | 1058 | 1211 | 8 | 3.9 | 750 | 0.62 | Comparative Example |

*1: An area fraction of ferrite in a region extending up to 10 μm in a sheet thickness direction from the surface of the steel sheet

*2: A Vickers hardness in a position of 15 μm in the sheet thickness direction from the surface of the steel sheet

The invention claimed is:

1. A high-strength steel sheet comprising: a chemical composition containing, in mass %, C: 0.13% or more and less than 0.40%, Si: 0.01% or more and 1.0% or less, Mn: 1.7% or less (excluding 0%), P: 0.030% or less, S: 0.010% or less, Al: 0.20% or less (excluding 0%), N: 0.010% or less, and the balance being Fe and incidental impurities; and a steel structure in which a total area fraction of martensite and bainite in a position of ¼ of a sheet thickness is 95% or more and 100% or less, the balance in a case where the total area fraction is not 100% contains retained austenite, and an area fraction of ferrite in a region extending up to 10 μm in a sheet thickness direction from a surface is 13% or more and 40% or less, wherein a tensile strength is 1320 MPa or more, and a Vickers hardness in a position of 15 μm in the sheet thickness direction from the surface satisfies a formula (1) below, $$Hv \geq 0.294 \times \sigma \quad (1)$$

where Hv represents a Vickers hardness in the position of 15 μm in the sheet thickness direction from the surface, and a represents a tensile strength (MPa).

2. The high-strength steel sheet according to claim 1, wherein the chemical composition further contains, in mass %, at least one of Mo: 0.005% or more and 0.3% or less, Cr: 0.01% or more and 1.0% or less, Nb: 0.001% or more and 0.10% or less, Ti: 0.001% or more and 0.10% or less, B: 0.0002% or more and 0.0050% or less, Sb: 0.001% or more and 0.1% or less, Ca: 0.0002% or more and 0.0040% or less, V: 0.003% or more and 0.45% or less, Cu: 0.005% or more and 0.50% or less, Ni: 0.005% or more and 0.50% or less, and Sn: 0.002% or more and 0.1% or less.

3. A method for manufacturing a high-strength steel sheet, the method comprising: a continuous annealing step of, under a condition where a dew point in a temperature region of 750° C. or more is −35° C. or less, holding a cold rolled steel sheet having the chemical composition according to claim 1 at an annealing temperature of 840° C. or more for 180 seconds or more and cooling the cold rolled steel sheet at a cooling start temperature of 740° C. or more and at an average cooling rate of 100° C./s or more through a temperature region from the cooling start temperature to 150° C.; and an overaging treatment step of, after the continuous annealing step, performing reheating as necessary and performing holding in a temperature region of 150 to 260° C. for 30 to 1500 seconds.

4. A method for manufacturing a high-strength steel sheet, the method comprising: a continuous annealing step of, under a condition where a dew point in a temperature region of 750° C. or more is −35° C. or less, holding a cold rolled steel sheet having the chemical composition according to claim 2 at an annealing temperature of 840° C. or more for 180 seconds or more and cooling the cold rolled steel sheet at a cooling start temperature of 740° C. or more and at an average cooling rate of 100° C./s or more through a temperature region from the cooling start temperature to 150° C.; and an overaging treatment step of, after the continuous annealing step, performing reheating as necessary and performing holding in a temperature region of 150 to 260° C. for 30 to 1500 seconds.

* * * * *